United States Patent [19]

Kwantes et al.

[11] 4,325,579

[45] Apr. 20, 1982

[54] WELL FOR THE SOLUTION MINING OF SALT FROM AN UNDERGROUND SALT FORMATION AND A METHOD FOR OPERATING SAID WELL

[75] Inventors: Cornelis Kwantes; Michael Mansell; Bob P. Stor, all of Sappemeer, Netherlands

[73] Assignee: Shell Internationale Research, The Hague, Netherlands

[21] Appl. No.: 102,494

[22] Filed: Dec. 11, 1979

[30] Foreign Application Priority Data

Jan. 12, 1979 [NL] Netherlands ..... 7900249

[51] Int. Cl.[3] ..... E21B 43/28

[52] U.S. Cl. ..... 299/5; 166/80; 166/325; 166/242; 166/313

[58] Field of Search ..... 166/325, 80, 242, 73, 166/311-315; 299/4, 5

[56] References Cited

U.S. PATENT DOCUMENTS

| | | | |
|---|---|---|---|
| 2,810,440 | 10/1957 | Kennedy et al. | 166/242 |
| 3,020,955 | 2/1962 | Tausch | 166/312 X |
| 3,040,813 | 6/1962 | Tausch et al. | 166/313 |
| 3,080,922 | 3/1963 | Mater | 166/313 X |
| 3,095,038 | 6/1963 | Thompson et al. | 166/313 X |
| 3,366,419 | 1/1968 | Pasternak et al. | 299/5 |
| 3,391,962 | 7/1968 | Ruse | 299/5 |
| 3,637,261 | 1/1972 | Porter | 299/5 |

*Primary Examiner*—William F. Pate, III

*Attorney, Agent, or Firm*—Jones, Tullar & Cooper

[57] ABSTRACT

A well for the solution mining of salt from an underground salt formation, comprising a borehole (12) extending from the earth's surface downwards into the formation, a casing (10) that is cemented in said borehole down to the upper level of said formation and separate conduct means provided within said casing and extending through the borehole downwardly beyond said casing, respectively for introducing leaching water into the salt formation and for withdrawing pregnant leach liquor from said formation, which conduct means have adjustable effective lengths, said conduct means each comprising a tubing string (13, 14), the two strings extending parallel through said casing and at least one of said strings carrying a tailpipe (18, 19) of smaller diameter, which tailpipe is axially telescopic in said string, can extend downwardly beyond said string and carries a liner assembly (20, 21, 22, 23) at its upper part that can engage the inner wall of said string at any desired location above the bottom end of the string.

6 Claims, 3 Drawing Figures

WELL FOR THE SOLUTION MINING OF SALT FROM AN UNDERGROUND SALT FORMATION AND A METHOD FOR OPERATING SAID WELL

The invention relates to a well for the solution mining of salt from an underground salt formation, comprising a borehole extending from the earth's surface downwards into the formation, a casing that is cemented in said borehole down to the upper level of said formation and separate conduct means provided within said casing and extending through the borehole downwardly beyond said casing, respectively for introducing leaching water into the salt formation and for withdrawing pregnant leach liquor from said formation which conduct means have adjustable effective lengths.

When salt is mined, in particular in salt formations containing several types of salt, it is desirable to adjust the levels of introduction and withdrawal of liquid from time to time. It may be necessary, for example, to locate the outflow opening of the conduit means for leaching water at a higher or lower level in the formation in connection with the changing shape of the cavern which is formed in the salt formation owing to the salt dissolving therefrom, or to affect this shape. Especially the height of this outflow opening must be regularly changed during the salt mining operations if the intention is to mine the salt or salts from the salt formation in superimposed layer-like zones consecutively.

It is also desirable that the height of the bottom end of the conduit means for withdrawing pregnant leach liquor should be capable of adjustment. The composition or concentration of the aqueous salt solution present in the cavern differs over the height of this cavern, and by adjusting the withdrawing level it is possible to select the desired salt solution within the limits of the variations in composition of this solution in the cavern.

It is possible to use as conduit means tubing strings and to adjust the height of the bottom end of the supply string or of the production string in the salt formation by raising or lowering these strings from the well head, optionally by shortening and extending respectively the strings at the top ends thereof by one or more tube lengths. Since salt formations to be mined by solution (leaching) are usually located at a relatively great depth of, for example, more than 1,000 meters, the supply and production strings are also long and consequently heavy. Therefore, after the strings have been installed for the first time, whenever the level of the bottom ends thereof subsequently requires readjustment, heavy hoisting equipment is each time or permanently required.

It would in fact be possible to raise the position where the leaching water flows from the supply string into the salt formation or where the pregnant leach liquor enters the production string to a higher level without raising the entire supply or production string, namely by cutting or shooting off the bottom part of the string, or by drilling or shooting holes in this bottom part. However, these methods have considerable drawbacks. For example, a perforated bottom end of the string impedes the use of certain electrical instruments for the logging of data from the cavern. Of course, these methods also cannot be used for extending the strings to a greater depth in the cavern.

It has been proposed for salt solution mining to withdraw the pregnant leach liquor via a tubing string that extends through the borehole to the desired depth in the salt formation and to introduce the leaching water into the salt formation via the annular space between the casing of the borehole and the said tubing string, a tailpipe with liner assembly at its upper extremity being mounted axially telescopic in the bottom end of said casing which tailpipe forms an extension of said annular space below the casing (see U.S. Pat. No. 3,391,962). The liner assembly can engage the inner wall of said casing at any desired level and thereby the point of supply of leaching water can be adjusted at will.

However, as the liner assembly engages the casing's inner wall it would be impossible to apply a second tailpipe with liner assembly for adjusting the level of withdrawal of pregnant leach liquor.

In addition, the liner setting depth can only be adjusted either after removal of the inner string from the well, if the single-well embodiment of U.S. Pat. No. 3,391,962 is employed, or otherwise a set of two separate but interconnecting wells must be provided.

The object of the invention is to provide a system for adjusting the effective length of the conduit means for introducing leaching water and/or of the conduit means for withdrawing pregnant leach liquor, while obviating the abovementioned and other objections. To this end the well according to the invention is characterized in that said conduit means each is a tubing string, the two strings extend parallel through said casing and at least one of said strings carries a tailpipe of smaller diameter, which tailpipe is axially telescopic in said string, can extend downwardly beyond said string and carries a liner assembly at its upper part that can engage the inner wall of said string at any desired location above the bottom end of the string.

The liner assembly in the annular space between the upper part of the telescopic tailpipe and the lower part of the string comprises a packer provided near the top end of the telescopic tailpipe. During adjustment of the telescopic tailpipe the packer is held in a retracted position in which the packer does not engage the inner wall of the string. When the telescopic tailpipe has been brought in position, the packer is actuated to engage the string inner wall in a sealing manner.

It is possible to suspend the telescopic tailpipe from the well head by means of a cable or rods. The liner assembly at the top end of the telescopic tailpipe is, however, preferably provided with a hanger enabling said tailpipe to be suspended by means of clamps at desired levels in the lower part of the string. If the telescopic tailpipe must be telescoped, the hanger is disengaged from the inner surface of the string and subsequently re-secured in the new position of the telescopic tailpipe.

The coupling or uncoupling of the hanger and packer and the raising and lowering of the telescopic tailpipe is effected by means of controls to be lowered on a cable from the well head, which controls are again pulled out of the well and removed after completion of the desired operation. Hangers, packers and controls suitable for said purpose are known as such from petroleum drilling and production technology in which they are referred to by terms such as wireline production equipment and wireline tools.

The length of the telescopic tailpipe, at least at the beginning of the salt mining, is preferably at least equal to and most preferably somewhat greater than the thickness of the salt formation to be mined. Consequently, the length of the telescopic tailpipe is only a fraction of the total length of the relevant string, for example only 10–20% or even less. During the progress of the salt mining the original telescopic tailpipe can, if desired, be replaced by a shorter one and this operation can be repeated a number of times during the salt mining.

According to a preferred embodiment of the present invention the lower extremity of each string is provided with a valve that automatically closes if the relevant tailpipe is retracted in the string. A suitable embodiment of this valve is a downward-opening hinged valve which is kept in closed position by spring pressure. In the latter case the telescopic tailpipe is placed in the string in such a manner that the telescopic tailpipe projects in a low position from the bottom end of the string, in which case the bottom valve is open. The bottom valve can be opened by the telescopic tailpipe itself, for example because in said embodiment of the bottom valve as spring-operated hinged valve the telescopic tailpipe in its downward movement opens the valve against the spring pressure. If the telescopic tailpipe is completely raised above the bottom valve, the flap of said hinged valve will close owing to the spring pressure. If desired, the bottom valve can be so designed that the hinged valve can also be fixed in open position by means of controls to be lowered on a cable from the well head.

Both the supply string and the production string can be provided with a telescopic tailpipe and be provided with a bottom valve. In the raised position of the two telescopic tailpipes above the bottom valves these valves can be closed or close themselves. In this situation there is no longer any communication between the space in the cavern and the supply and production strings. The supply and production strings hang in a borehole in which a casing is placed which is secured with cement provided between the borehole and the casing. At the bottom end of the casing a packer is located which seals the passage between casing and strings, but which does not seal the passages through the supply and production strings projecting through said packer. If no other strings are mounted in the casing or if any other lines from or to the formation are closed, this implies that in the raised position of the telescopic tailpipes and closed position of the bottom valves the cavern is completely sealed.

This possibility to seal the cavern at the bottom of the strings when the salt mining is discontinued, either permanently or temporarily, is of great importance in some salt formations which can flow plastically; if the cavern communicates with a space of lower pressure, the salts will flow from the salt formation in the direction of the cavern. Consequently, soil displacements may occur around and above the formation, which may result, for example, in collapses in the cavern or subsidences at the surface. This risk can be avoided by shutting off the supply and production strings at the top end. However, the described embodiment according to the invention, in which the cavern is not shut off at the well head but at the bottom of the strings, has the advantage that the supply and production strings as such need not be kept under the high formation pressure, so that these strings remain easily accessible from the well head, for example for operations to be carried out therein. If the bottom valve is not fitted to the string itself but to the packer of the casing, it is even possible, if desired, to remove the entire string from the well whilst keeping the cavern closed off.

The borehole is usually drilled at least through the entire salt formation to be mined. Assuming that both the supply string and the production string are provided with a telescopic tailpipe according to the invention, the supply and production strings are suspended from the well head in the borehole in such a manner that by the telescopic movement of the telescopic tailpipes the bottom ends of the latter can be adjusted between the top and the bottom of the salt formation to be mined.

The invention also relates to a method for operating a well according to the invention in which a tailpipe is raised with the assistance of a hydraulic force obtained by closing the said tailpipe with a plug and creating hydraulic overpressure below the plug.

According to a method of salt mining according to the invention the production string provided with a telescopic tailpipe is placed in such a manner that the bottom end of this tailpipe is near the bottom of the formation. The bottom end of the telescopic tailpipe of the supply string is located some distance above the bottom end of the tailpipe of the production string. The leaching water is pumped from the well head through the supply string and its tailpipe into the formation. The leaching water dissolves salt from the formation, thereby forming a cavern which is filled with leach liquor. The pregnant leach liquor at the bottom of the cavern is withdrawn via the tailpipe of the production string and passes to the well head.

By maintaining an inert liquid which is lighter than and immiscible with the leach liquor, for example oil, close to the level of the bottom end of the telescopic tailpipe of the supply string, the dissolving process will be limited to the zone below this level. This ensures that the cavern expands laterally, thus producing the largest possible yield with any maximum cavern dimensions which may be imposed by a public authority, for example.

After a certain quantity of salt is dissolved from the formation, the supply of leaching water is stopped and the telescopic tailpipe of the supply string is raised over a certain distance and re-secured in the supply string, after which the oil level is adjusted and leaching water is again supplied and the next horizontal layer-like zone of the salt formation is dissolved. This operation may be repeated several times, each time a higher zone of the salt formation being dissolved. During this operation the position of the production string need not be changed. In this method of dissolving the salt formation the composition of the leach liquor will differ over the height of the cavern, especially in salt formations consisting of several components. At the location of the outflow opening of the supply string, that is in the top of the cavern, the leach liquor will contain a very small quantity of salt, whereas towards the bottom of the cavern the density of the leach liquor increases.

The composition of the leach liquor at a certain level in the cavern depends on many factors, inter alia on the composition of the salt formation and the quantity of leaching water per unit of time pumped into the cavern. By providing also the production string with a telescopic tailpipe and adjusting the latter to a certain height in the formation, a choice may be made with respect to the composition of the leach liquor to be passed upwards through the production string.

The invention can also be used advantageously for other methods of solution mining of salts, for example that in which leaching water is supplied via the supply string at the bottom part of the cavern and pregnant leach liquor is discharged from the top of the cavern.

The invention is in particular suitable for salt mining from formations consisting of several components, for example sodium chloride with potassium chloride and/or magnesium chloride, in which it is desirable to make frequent adjustments to the injection point of the leaching water.

Owing to the small length of the telescopic tailpipe in relation to the total length of the string, the own weight of the former is also relatively low. Even if the telescopic tailpipe jams slightly, it can be raised with a cable from the well head. According to the invention it is also possible to use, wholly or partly, hydraulic forces to raise the telescopic tailpipe, instead of or to supplement the pulling force of the cable, for example when using a relatively heavy telescopic tailpipe or if the telescopic tailpipe jams in the cavern in a considerable degree. To this end, after the supply of leaching water is interrupted, a plug is secured to the top end of the telescopic tailpipe of the supply string which plug shuts off the telescopic tailpipe. The plug extends in radial direction also beyond the telescopic tailpipe as far as or close to the inner wall of the string, so that the telescopic tailpipe with the plug attached thereto can function as a piston in the string. If the liner assembly of the telescopic tailpipe is provided with the above-mentioned releasable hanger and packer, the latter two parts are released, while a higher hydraulic pressure is built up below the plug than above it. The telescopic tailpipe is pumped to the desired higher position by means of this pressure difference. After the telescopic tailpipe is fixed in the new position and the packer is also re-expanded, the plug is removed from the telescopic tailpipe and finally, after the oil level has been adjusted to the new depth of the bottom end of the telescopic tailpipe of the supply string, the pumping of the leaching water is resumed.

Said pressure difference across the plug in the supply string can be obtained by pumping liquid into the cavern, for example through the other (production) string, at the same time allowing liquid to escape from the supply string. In a similar manner the production string can be adjusted with hydraulic assistance.

According to another embodiment of the present invention the said overpressure is created below the plug by pumping liquid into the string through a non-return valve situated in the string wall below the plug on the tailpipe in said string.

The invention will now be discussed by way of example with reference to the appertaining diagrammatic drawing.

FIG. 1 of this drawing shows in longitudinal cross-section the bottom part of a well according to the invention.

Figure 1:
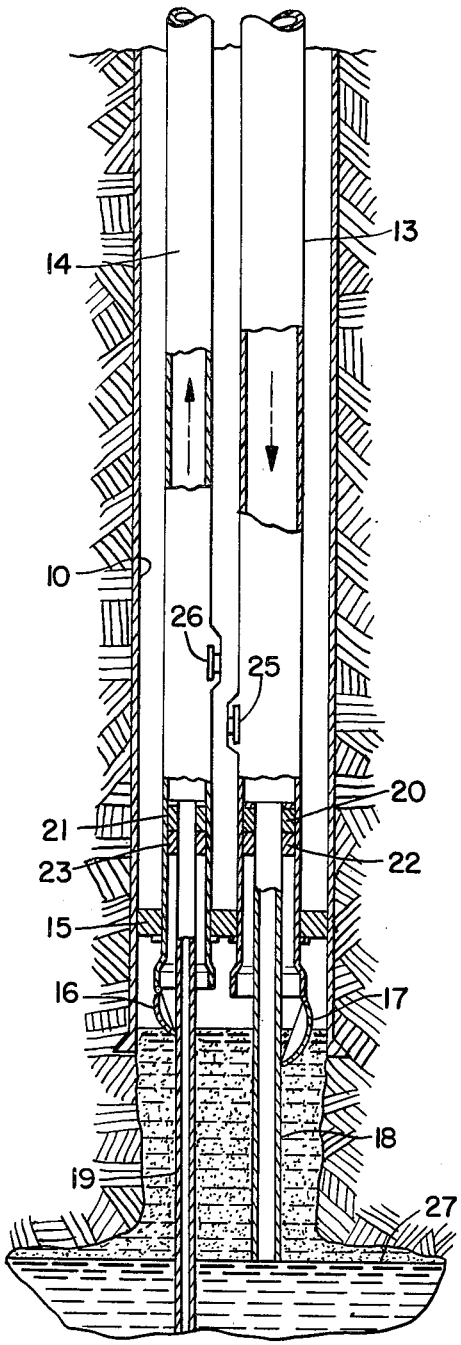

The drawing shows the bottom part of a well with a borehole 12 in which a casing 10 is cemented. The casing 10 extends down to just above the salt formation to be mined. The uncased borehole extends at least through the full thickness of the salt formation and preferably to a slightly greater depth. In the casing 10 a supply string 13 for the supply of leaching water and a production string 14 for the withdrawal of pregnant leach liquor extend parallel to each other. The strings 13 and 14 are suspended from the well head. Near the bottom end of the casing a packer 15 is located through which the bottom parts of the strings 13 and 14 pass and which seals locally the annular passage between the casing 10 and the strings 13 and 14. At the bottom end of each of the strings 13, 14 a hinged valve 16, 17 is fitted below the packer 15, which hinged valves are provided with springs which tend to close the valves as a result of which the bottom ends of the strings 13 and 14 are closed. In the position drawn in FIG. 1, however, the valves are kept open by the telescopic tailpipes 18, 19 which are suspended in the strings 13, 14 with hangers 22, 23 secured around the top ends of the lines 18, 19. A suitable bottom valve is the "Otis flapper valve".

Further, around the top end of the telescopic tailpipes packers 20, 21 are secured which locally seal the annular spaces between the strings and the telescopic tailpipes placed therein. The packers and hangers together form the liner assemblies according to the invention. The telescopic tailpipes with the hangers 22, 23 and packers 20, 21 secured thereto are lowered on a cable from the well head into the strings without the hangers and packers functioning as such. After the telescopic tailpipes have arrived at the desired depth, the hangers are activated by means of the cable, as a result of which the telescopic tailpipes are clamped against the inner wall of the strings. The packers may be designed as an integral unit with the hangers, if desired in such a manner that by the activation of the hangers the packers are also expanded and pressed against the inner wall of the strings in a sealing manner.

The packers may also be made as elements which can be applied and controlled separately. Also the release of the hangers and packers and the raising or lowering of the telescopic tailpipes are effected by means of a cable having adapted controls attached to the bottom end thereof. All these aids and techniques are known as such from petroleum drilling and production technology and consequently require no further explanation.

A hanger with packer which is suitable for the present purpose is the "Otis Packer Type GO". A suitable control is the "Otis Running and Pulling Tool Type GS". Such and similar further equipment and aids stated in this application, such as plug 24 (FIG. 3), which is discussed below, are supplied by Otis Engineering Corporation, Dallas, Tex.

Non-return valves 25, 26 are provided in the wall of respectively the strings 13, 14 at some distance above the bottom end thereof. Through these valves liquid which is pumped from the well head into the passage between the casing 10 and the strings 13, 14 may be injected, if desired, into the strings 13, 14. The non-return valves 25, 26 can be removed by means of wire line techniques and, if desired, be replaced by seals.

The telescopic tailpipes 18, 19 have a length which is greater than the thickness of the salt formation to be dissolved, at least at the beginning of the salt mining operation. The diameter of the supply string 13 and appurtenant telescopic tailpipe 18 is preferably larger than that of the corresponding production string 14 and telescopic tailpipe 19, since it is desirable to use the supply string for lowering measuring instruments into the salt formation, and these instruments are easier to lower in a wide string. It is moreover desirable to use a relatively narrow production string in order to obtain a high ascent velocity in this string. This high velocity prevents a sharp fall in the temperature of the rising pregnant leach liquor, thereby reducing the risk of crystallization of salt in the production string. In addition, this danger of crystallization can also be reduced or prevented by injecting water into the production string through the non-return valve 26.

The bottom end of the telescopic tailpipe 19 of the production string is located near the bottom of the salt formation to be mined, while initially, i.e. when mining the first horizontal layer, the bottom end of the telescopic tailpipe 18 of the supply string is located some distance, for example 2–5 m, above said level.

During the salt mining operation leaching water is pumped from the well head to the formation through the supply string 13 and its tailpipe 18 and pregnant leach liquor from the cavern is passed to the well head through the production string 14 and its tailpipe 19. In advance, such a quantity of oil is pumped into the well through the supply string and tailpipe, that the lower oil level 27 is located close to the level of the bottom end of the telescopic tailpipe 18. The oil in the borehole serves the purpose of sealing the roof of the cavern, so that the leaching water from the telescopic tailpipe 18 dissolves the salt in the formation mainly in lateral direction. After a layer-like zone of the formation is dissolved to a desired degree, the supply of leaching water is interrupted. By means of controls lowered on a cable from the well head the packer 20 and the hanger 22 are detached from the wall of the supply string 13 and the telescopic tailpipe 18 is raised to a desired higher level where it is again secured in the string 18 by means of the hanger 22 while the packer 20 is also brought to engage the string. The cable and controls are removed from the string 13. The lower oil level in the borehole is readjusted to the level of the bottom end of the telescopic tailpipe 18; any shortage or excess of oil is optionally made up and discharged respectively through the supply string 13. The supply of leaching water is now resumed and a layer of salt located at a higher level is dissolved. This procedure is repeated until the salt formation is dissolved over the entire desired thickness. If desired, it is also possible to raise the telescopic tailpipe 19 of the production string 14 in a similar manner. For lowering the telescopic tailpipes 18, 19 a similar procedure is followed, albeit that in this case the tailpipes are not raised but lowered by their own weight. Instead of repeatedly raising the telescopic tailpipe 18 over a certain height for dissolving always higher zones of the salt formation, the telescopic tailpipe can also be pulled out of the well completely and replaced by a telescopic tailpipe which is shorter than the previous one. Such a procedure can be applied, for example, to prevent the telescopic tailpipe 18 extending as far as above the non-return valve 25, which may be undesirable.

Figure 2:
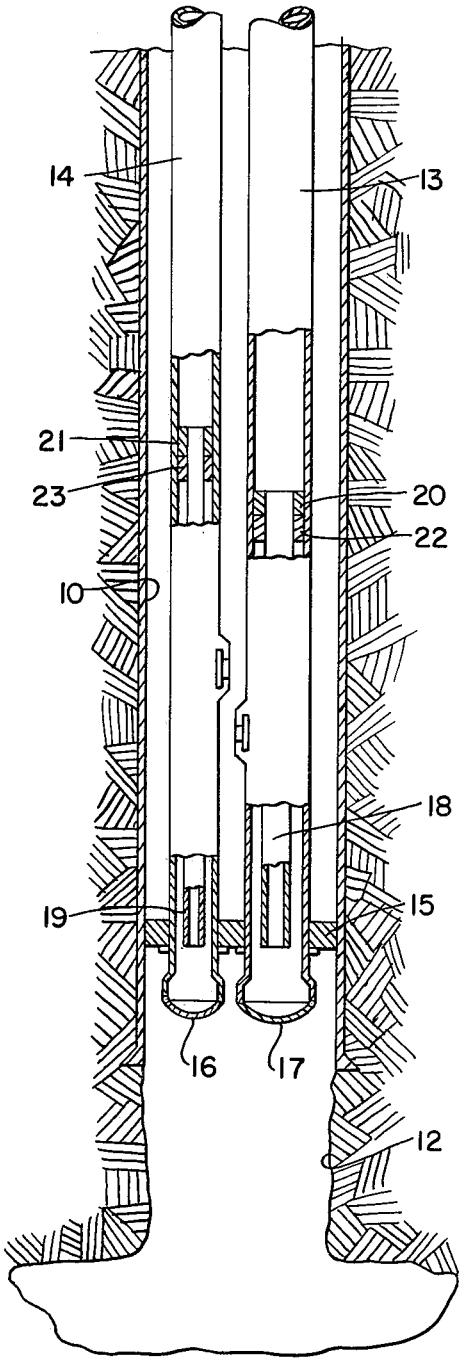
FIG. 2 shows the well of FIG. 1 with completely raised telescopic tailpipes.

FIG. 2 shows the telescopic tailpipes in fully raised position, the bottom ends thereof being located above the bottom valves, which are then closed. The cavern is now completely shut off with the result that the pressure in the cavern is maintained and no substantial plastic flow of the salt formation will occur. Moreover, the interior of the supply and production strings remains freely accessible from the well head.

Figure 3:
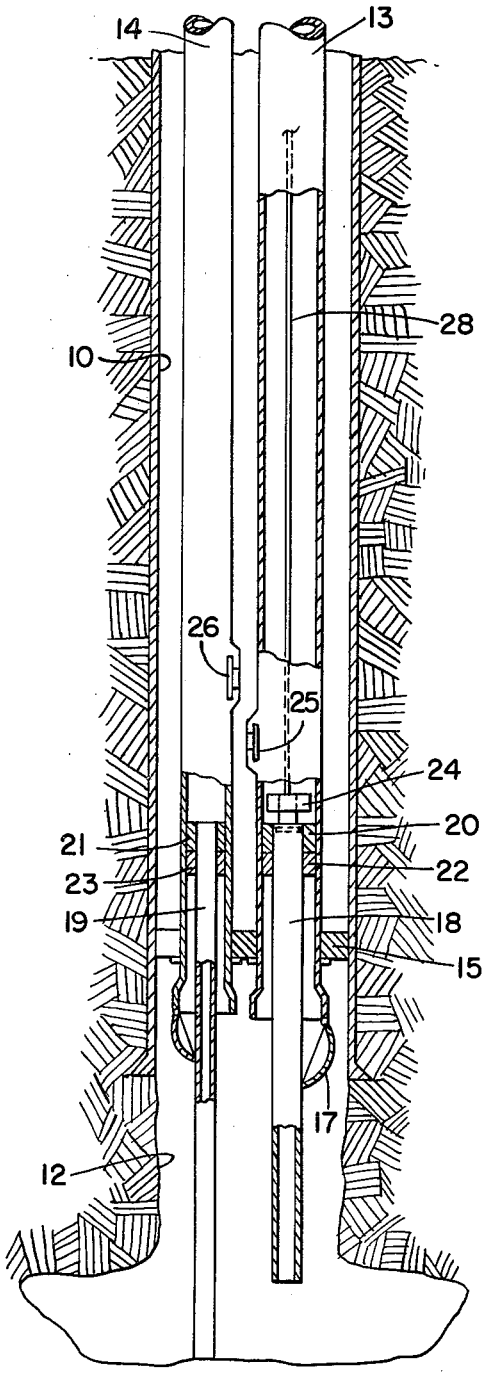
FIG. 3 shows the well of FIG. 1 in a special design for raising the telescopic tailpipe of the supply string with the assistance of hydraulic force.

FIG. 3 shows how to use hydraulic forces to supplement the pulling force by which the telescopic tailpipe is raised by the cable. A plug 24 (Otis TFL Locomotive), attached to a cable 28, is pumped from the well head down through the supply string 13. This plug, which is provided with a coupling (Otis Running/Pulling Tool Type GS) at the bottom end, automatically couples to the top end of the telescopic tailpipe 18 and shuts off the said top end. Moreover, the plug locally seals the flow passage through the string 13 in a sufficient degree to function as a piston in said string. Liquid is now pumped into the cavern through the production string 14, while liquid is allowed to flow out of the supply string 13, with the result that an upward hydraulic force is exerted on the plug. This force, together with the pulling force on the cable 28, moves the telescopic tailpipe 18 upwards. Even if the telescopic tailpipe 18 has moved upwards to such a level that the bottom valve 17 closes, liquid can be pumped under the plug 24 through the non-return valve 25 (see FIG. 2). In the new position of the telescopic tailpipe 18 the plug 24 is removed, the tailpipe is again suspended with the hanger 22, the packer 20 is again operated to engage the string 13 and the plug 24 is removed.

What is claimed is:

1. A well for the solution mining of salts from an underground salt formation, comprising a borehole extending from the earth's surface downwards into the formation, a casing that is cemented in said borehole down to the upper level of said formation, two parallel tubing strings of effective lengths extending through said casing downwardly beyond said casing for introducing leaching water into the salt formation and withdrawing pregnant leach liquor from said formation, each of said strings carrying a tail pipe of a diameter smaller than the diameter of the string, which tail pipe is axially telescopic in said string, can extend downwardly beyond said string and carries a liner assembly at its upper part that can engage the inner wall of said string at any desired location above the bottom end of the string, at least one of said tubing strings being provided at its lower extremity with a valve that can be automatically closed if the tail pipe is raised into the string; the well additionally being provided with plug means that can be lowered onto the upper extremity of at least one of the tail pipes in order to seal the flow passage of liquid and with pumping means for pumping liquid via the tubing string and the tail pipe having the unrestricted flow passage into the salt formation in order to increase the hydraulic pressure therein to cause or provide substantial assistance in raising the sealed tail pipe.

2. A method for operating a well for the solution mining of salt from an underground salt formation, said well comprising a borehole extending from the earth's surface downwards into the formation, a casing that is cemented in said borehole down to the upper level of said formation, two parallel tubing strings of adjustable effective lengths extending through said casing downwardly beyond said casing for introducing leaching water into the salt formation and withdrawing pregnant leach liquor from said formation, at least one of said strings carrying a tail pipe of a diameter smaller than the diameter of the string, which tail pipe is axially telescopic in said string, can extend downwardly beyond said string and carries a liner assembly at its upper part that can engage the inner wall of said string at any desired location above the bottom end of the string, each tubing string being provided in its lower extremity with a valve that automatically closes if the relevant tail pipe is retracted in the string; said method comprising closing a tail pipe with a plug and creating hydraulic overpressure below the plug thereby to assist displacing of the tail pipe between operative locations thereof with respect to the cooperating tubing string.

3. A method as claimed in claim 2, in which the overpressure is created by pumping liquid into the borehole through the string pertaining to the other tailpipe.

4. A method as claimed in claim 2, in which the overpressure is created by pumping liquid into the string through a non-return valve situated in the string wall below the plug on the tailpipe in said string.

5. A method for operating a well for the solution mining of salt from an underground salt formation, said well comprising a borehole extending from the earth's surface downwards into the formation, a casing that is cemented in said borehole down to the upper level of said formation, two parallel tubing strings of adjustable effective lengths extending through said casing downwardly beyond said casing for introducing leaching water into the salt formation and withdrawing pregnant leach liquor from said formation, at least one of said strings carrying a tail pipe of a diameter smaller than the diameter of the string, which tail pipe is axially telescopic in said string, can extend downwardly beyond said string and carries a liner assembly at its upper part that can engage the inner wall of said string at any desired location above the bottom end of the string; said method comprising closing a tail pipe with a plug and creating hydraulic overpressure below the plug by pumping liquid into the borehole through the string pertaining to the other tail pipe, thereby to assist displacing of the tail pipe between operative locations thereof with respect to the cooperating tubing string.

6. A method for operating a well for the solution mining of salt from an underground salt formation, said well comprising a borehole extending from the earth's surface downwards into the formation, a casing that is cemented in said borehole down to the upper level of said formation, two parallel tubing strings of adjustable effective lengths extending through said casing downwardly beyond said casing for introducing leaching water into the salt formation and withdrawing pregnant leach liquor from said formation, at least one of said strings carrying a tail pipe of a diameter smaller than the diameter of the string, which tail pipe is axially telescopic in said string, can extend downwardly beyond said string and carries a liner assembly at its upper part that can engage the inner wall of said string at any desired location above the bottom end of the string; said method comprising closing a tail pipe with a plug and creating hydraulic overpressure below the plug by pumping liquid into the string pertaining to said tail pipe through a non-return valve situated in the string wall below said plug, thereby to assist displacing of the tail pipe between operative locations thereof with respect to the cooperating tubing string.

* * * * *